US009121659B1

(12) United States Patent
Chang

(10) Patent No.: US 9,121,659 B1
(45) Date of Patent: Sep. 1, 2015

(54) CROSSBOW ASSEMBLY

(71) Applicant: Eldwin Chang, Taichung (TW)

(72) Inventor: Eldwin Chang, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/453,620

(22) Filed: Aug. 7, 2014

(51) Int. Cl.
*F41B 5/12* (2006.01)
*F41B 5/14* (2006.01)

(52) U.S. Cl.
CPC . *F41B 5/123* (2013.01); *F41B 5/12* (2013.01); *F41B 5/14* (2013.01); *F41B 5/1403* (2013.01)

(58) Field of Classification Search
CPC ..... F41B 5/12; F41B 5/123; F41B 5/14
USPC ..... 124/25, 86, 88
See application file for complete search history.

(56) References Cited

U.S. PATENT DOCUMENTS

| | | | | |
|---|---|---|---|---|
| 4,827,893 | A * | 5/1989 | Nishioka | 124/25 |
| 5,119,797 | A * | 6/1992 | Anderson | 124/25 |
| 5,522,373 | A * | 6/1996 | Barnett | 124/25 |
| 5,553,596 | A * | 9/1996 | Bednar | 124/25 |
| 5,630,405 | A * | 5/1997 | Nizov | 124/25 |
| 7,178,514 | B2 * | 2/2007 | Chang | 124/25 |
| 7,624,724 | B2 * | 12/2009 | Bednar et al. | 124/25 |
| 7,938,108 | B2 * | 5/2011 | Popov et al. | 124/25 |
| 7,997,258 | B2 * | 8/2011 | Shepley et al. | 124/25 |
| 8,033,275 | B2 * | 10/2011 | Bednar et al. | 124/25 |
| 8,225,777 | B2 * | 7/2012 | Chu | 124/25 |
| 8,434,463 | B2 * | 5/2013 | Bednar et al. | 124/25 |
| 8,627,811 | B1 * | 1/2014 | Darlington | 124/25 |
| 8,701,641 | B2 * | 4/2014 | Biafore, Jr. | 124/25 |
| 8,701,642 | B2 * | 4/2014 | Biafore et al. | 124/25 |
| 8,813,735 | B2 * | 8/2014 | Biafore et al. | 124/25 |
| 8,991,380 | B2 * | 3/2015 | Bednar et al. | 124/89 |
| 2006/0169259 | A1 * | 8/2006 | Chang | 124/25 |
| 2007/0028907 | A1 * | 2/2007 | Bednar et al. | 124/25 |
| 2008/0127956 | A1 * | 6/2008 | Bednar et al. | 124/25 |
| 2009/0101126 | A1 * | 4/2009 | Anderson | 124/25 |
| 2009/0178658 | A1 * | 7/2009 | Barnett | 124/25 |
| 2010/0116259 | A1 * | 5/2010 | Popov et al. | 124/25 |
| 2011/0203561 | A1 * | 8/2011 | Shaffer et al. | 124/25 |
| 2011/0271938 | A1 * | 11/2011 | Chu | 124/25 |
| 2012/0006311 | A1 * | 1/2012 | Bednar et al. | 124/25 |
| 2012/0192842 | A1 * | 8/2012 | Barnett | 124/25 |
| 2012/0199106 | A1 * | 8/2012 | Bednar et al. | 124/25 |
| 2012/0298087 | A1 * | 11/2012 | Trpkovski | 124/25 |
| 2013/0061837 | A1 * | 3/2013 | Bednar et al. | 124/25 |
| 2013/0291847 | A1 * | 11/2013 | Darlington | 124/25 |
| 2014/0069401 | A1 * | 3/2014 | McPherson | 124/25 |
| 2014/0069404 | A1 * | 3/2014 | McPherson | 124/25 |
| 2014/0283805 | A1 * | 9/2014 | Dunlop | 124/25 |

* cited by examiner

*Primary Examiner* — Alexander Niconovich

(57) ABSTRACT

A crossbow assembly includes a body having an insertion hole and a retention member protrudes from the insertion hole. A barrel has a first end inserted into the insertion hole and a second end of the barrel extends beyond the insertion hole. A recess is defined in the top of the second end of the barrel. An upper portion is connected to the top of the barrel. A lower portion is formed at the underside of the barrel. The thickness of the upper portion is smaller than or equal to a half of that of the lower portion. A bow unit is connected to the second end of the upper portion and includes a riser, two limbs and two cam units. The upper portion is connected to two plates extending from a slot in the riser by two bolts. The crossbow assembly has a stable weight center.

7 Claims, 6 Drawing Sheets

CROSSBOW ASSEMBLY

BACKGROUND OF THE INVENTION

1. Fields of the Invention

The present invention relates to a crossbow assembly, and more particularly, to a crossbow assembly that has a stable weight center and is easily assembled.

2. Descriptions of Related Art

The conventional sport archery generally comprises two different types, one of which uses bows and the other one uses crossbows. The bow generally has a riser with two limbs on two ends of the riser. For the bows, the user pulls the string connected between the two limbs to shoot the arrow by the force of the string. For the crossbows, the user simply pulls the trigger to shoot the arrow. Both of the use of the bows and the crossbows require concentration to keep the bows and the crossbows stable so as to shoot the arrows precisely.

FIGS. 5 and 6 show a conventional crossbow which has a body 10, a barrel 20 connected to the body 10, and a bow 30 which is connected to the barrel 20. The bow 30 has a string so as to be pulled to shoot the arrows. The body 10 has a recess 101 defined in a top of the front end thereof and the barrel 20 is inserted into the recess 101, the front end of the barrel 20 projects beyond the front end of the body 10. A slot 201 is defined in the front end of the barrel 20 so as to form an upper portion 202 and a lower portion 203. A tubular member 40 is connected to the front end of the lower portion 203. The bow 30 is connected to the front end of the lower portion 203 and a bolt 50 extends through the bow 30 and is threadedly connected to the tubular member 40 so as to connect the bow 30 to the barrel 20. The barrel 20 usually is made of plastic which is light in weight, however, the plastic is not strong enough to bear the frequent vibration at the position of the tubular member 40 when using the crossbow. Besides, the tubular member 40 is connected to the lower portion 203 so that the whole weight of the bow 30 is supported on the lower portion 203, and this causes the portion between the bow 30 an the barrel 20 to be tilt and affects the precision of shooting. In addition, the arrow is positioned with the groove 204 in the barrel 20 before shooting, the arrow may slightly expand the two sides of the groove 204. A permanent gap is formed after a period of use, and the arrow is therefore not able to be stably positioned in the groove 204. The gap also generates noise when shooting. In order to obtain a secure and strong structure between the bow 30 and the barrel 20, the barrel 20 is made by metal. Nevertheless, the metal made barrel 20 increases the cost and weight.

The present invention intends to provide a crossbow assembly which eliminates the shortcomings mentioned above.

SUMMARY OF THE INVENTION

The present invention relates to a crossbow assembly and comprises a body having an insertion hole defined therein and a retention member protrudes from the insertion hole. A barrel has the first end thereof inserted into the insertion hole and connected with the retention member. The second end of the barrel extends beyond the insertion hole. A recess is defined in the top of the second end of the barrel. An upper portion is connected to the top of the barrel. The first end of the upper portion is inserted into the insertion hole. A lower portion is formed at the underside of the barrel. The recess is located between the upper portion and the lower portion. The thickness of the upper portion is smaller than or equal to a half of that of the lower portion. Two threaded holes are defined in the second end of the upper portion.

A bow unit is connected to the second end of the upper portion and has a riser, two limbs connected to two ends of the riser, and two cam units respectively connected to the two limbs. A slot is defined in the riser and two plates extend from the inside of the slot. The two plates are located at a distance from each other. Each plate has a hole. Two bolts extend through the two holes of the two plates and are threadedly connected to the two threaded holes of the upper portion.

Preferably, the upper portion has a flight groove defined centrally in the top thereof, and the flight groove communicates with the recess.

Preferably, the cam units each have a cam connected to the limb corresponding thereto. A string is wrapped between the two cams on the two limbs. A buss cable is connected between the two cams and passes through the recess and is located between the upper portion and the lower portion. The string extends above the upper portion.

Preferably, wherein two flanges respectively extend from two sides of the slot of the riser and contact the top of the upper portion. Preferably, the body has a main part, a stock and a grip. The insertion hole is defined in the top of the main part. The stock is located at the first end of the main part. The grip extends from the underside of the main part and a trigger is pivotably connected to the grip so as to activate the retention member.

The primary object of the present invention is to provide a crossbow assembly with stable weight center so as to increase the precision of shooting.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
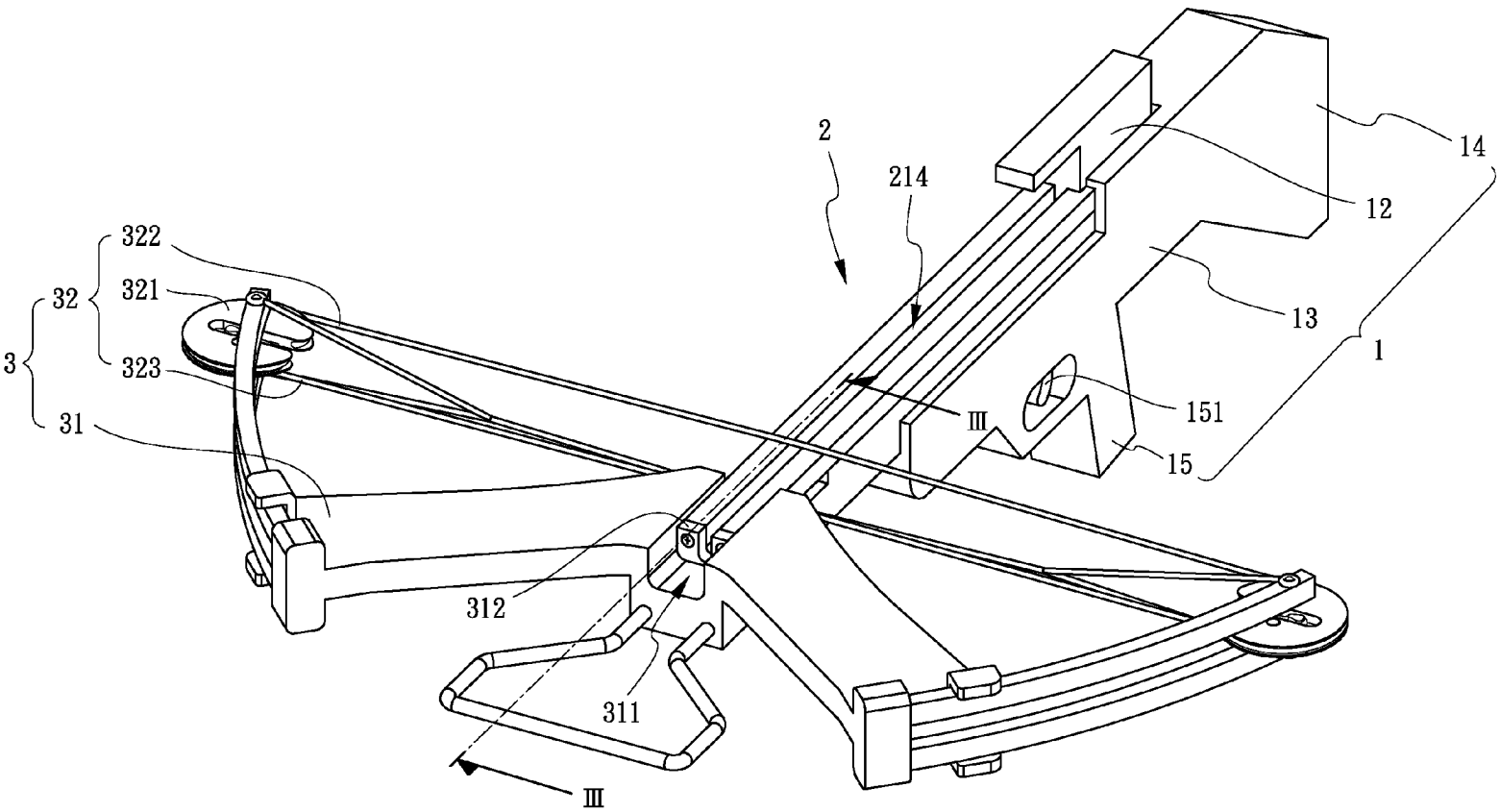
FIG. 1 is a perspective view to show the crossbow assembly of the present invention.
Figure 2:
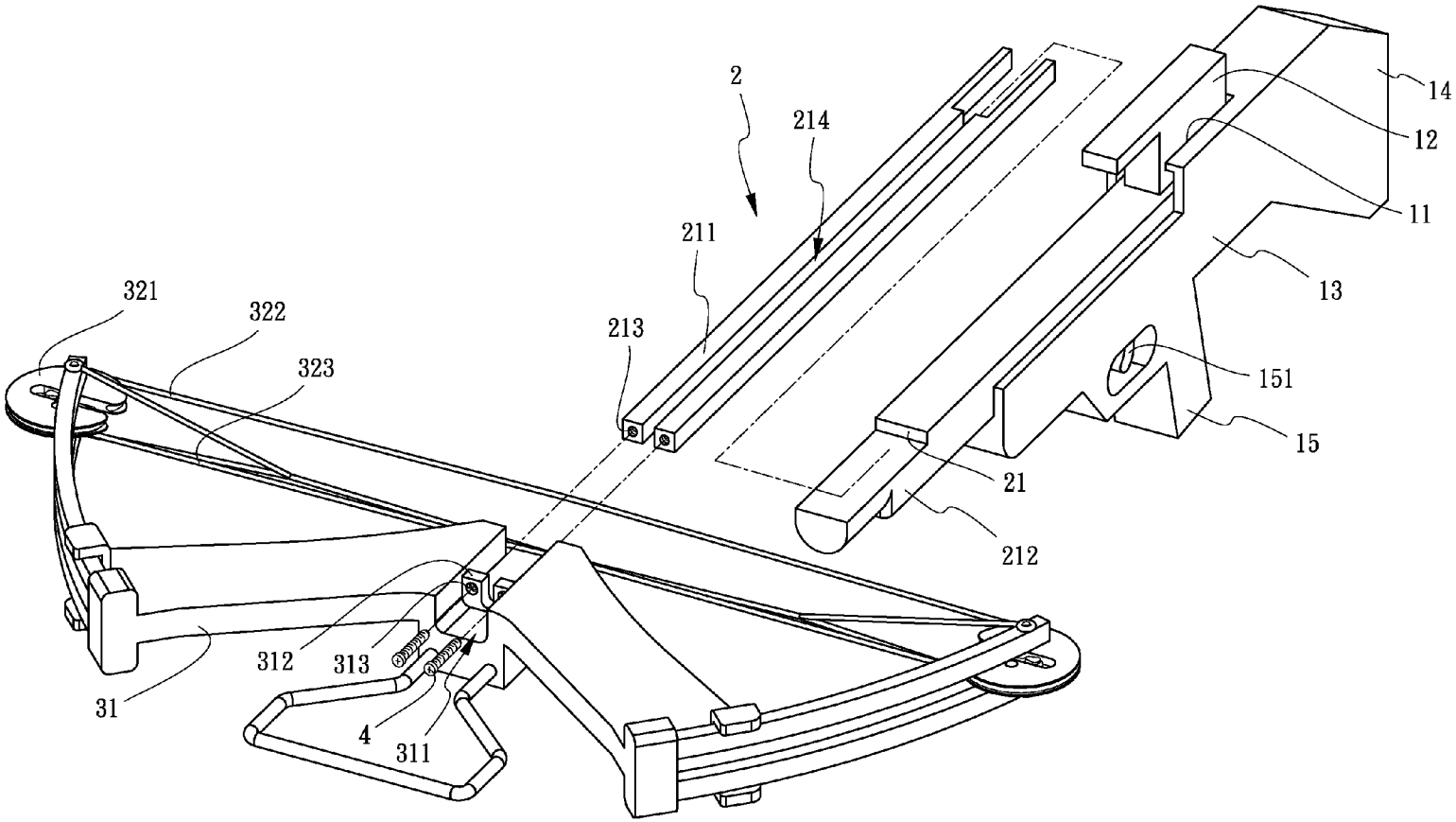
FIG. 2 is an exploded view of the crossbow assembly of the present invention.
Figure 3:
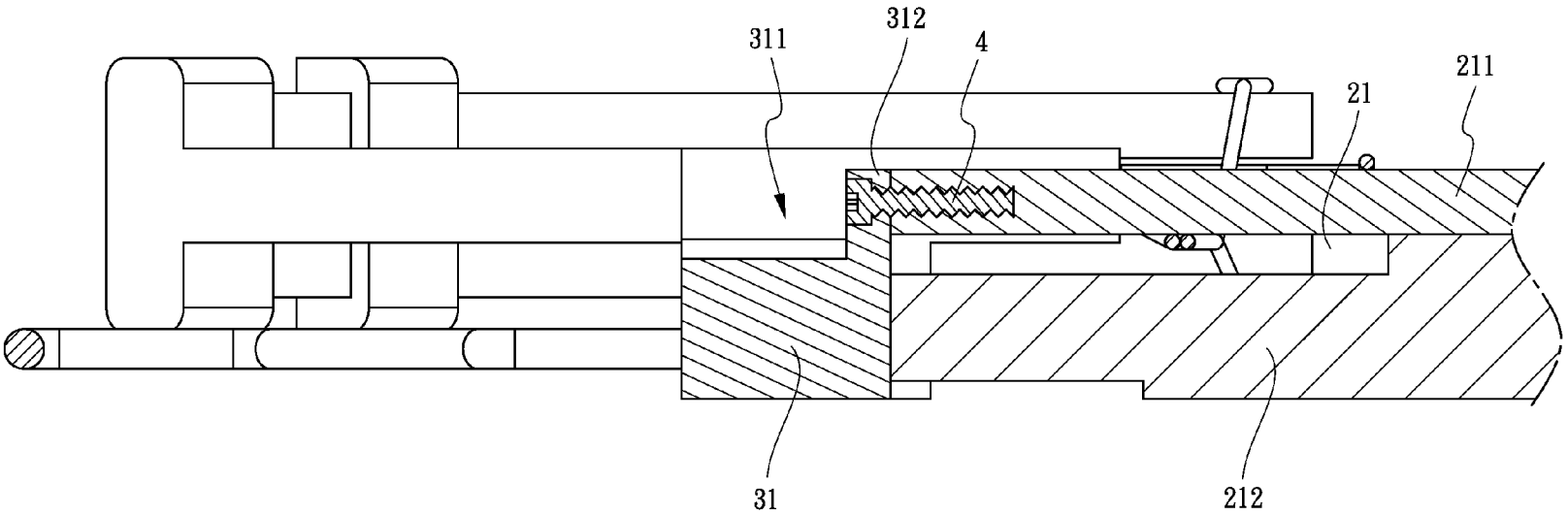
FIG. 3 is a cross sectional view, taken along line a-A of FIG. 1.

Referring to FIGS. 1 to 3, the crossbow assembly of the present invention comprises a body 10 which has a main part 13, a stock 14 and a grip 15. An insertion hole 11 is defined in the top of the main part 13. The stock 14 is located at the first end of the main part 13. The grip 15 extends from the underside of the main part 13 and a trigger 151 is pivotably connected to the grip 15 so as to activate a retention member 12 protruding from the insertion hole 11 to shoot the arrows.

A barrel 2 has the first end thereof inserted into the insertion hole 11 and is connected with the retention member 12. The second end of the barrel 2 extends beyond the insertion hole 11. A recess 21 is defined in the top of the second end of the barrel 2. An upper portion 211 is connected to the top of the barrel 2. The first end of the upper portion 211 is inserted into the insertion hole 11. A lower portion 212 is formed at the underside of the barrel 2. The recess 21 located between the upper portion 211 and the lower portion 212. It is noted that the thickness of the upper portion 211 is smaller than or equal to a half of that of the lower portion 212. Two threaded holes 213 are defined in the second end of the upper portion 211.

A bow unit 3 is connected to the second end of the upper portion 211 and comprises a riser 31, two limbs connected to two ends of the riser 31, and two cam units 32 respectively connected to the two limbs. A slot 311 is defined in the top side of the riser 31 and two plates 312 extend from the inside of the slot 311. The two plates 312 are located at a distance from each other, and each plate 312 has a hole 313. Two bolts 4 extend through the two holes 313 of the two plates 312 and are threadedly connected to the two threaded holes 213 of the upper portion 21 so as to connect the bow unit 3 to the upper portion 211. The upper portion 211 has a flight groove 214 defined centrally in the top thereof, and the flight groove 214 communicates with the recess 21. The different thickness of the upper portion 211 and the lower portion 212 allows the user to stable hold/support the crossbow assembly and shoot. Thanks to the threaded holes 213 and the bolts 4, the two sides of the flight groove 214 are secured by the bolts 4 such that the gap mentioned in the conventional bow can be reduced, also the noise accompany with the gap is reduced.

The cam units 32 each have a cam 321 connected to the limb corresponding thereto. A string 322 is wrapped between the two cams 321 on the two limbs, and a buss cable 323 is connected between two respective sides of the two cams 321. The buss cable 323 passes through the recess 21 and is located between the upper portion 211 and the lower portion 212. The string 322 extends above the upper portion 211. The arrow is positioned in the flight groove 214 which ensures that the arrow is oriented straight forward to have a precise shooting. The string 322 is pulled toward the retention member 12 and the energy stored to the pulled string 322 is used to shoot the arrow.

The bolts 4 connect the bow unit 3 to the upper portion 211 so that the weight center of the riser 31 is located on the upper portion 211, this can avoid the riser 31 from tilting to affect the shooting. In order to have sufficient strength while the weight is light, the upper portion 211 is made by metal, and the lower portion 212 is made by plastic. The lower portion 212 and the body 1 are integrally formed as a one piece. The material for the upper portion 211 and the plastic portion 212 may be varied according to practical needs. The upper portion 211 is made by metal so that the threaded holes 213 are easily made. The upper portion 211 is located in the recess 311 of the raiser 31 and contacts against the plates 312. The upper portion 211 is then connected to the riser 31 by the two bolts 4 to obtain the crossbow assembly with the desired features.

Figure 4:
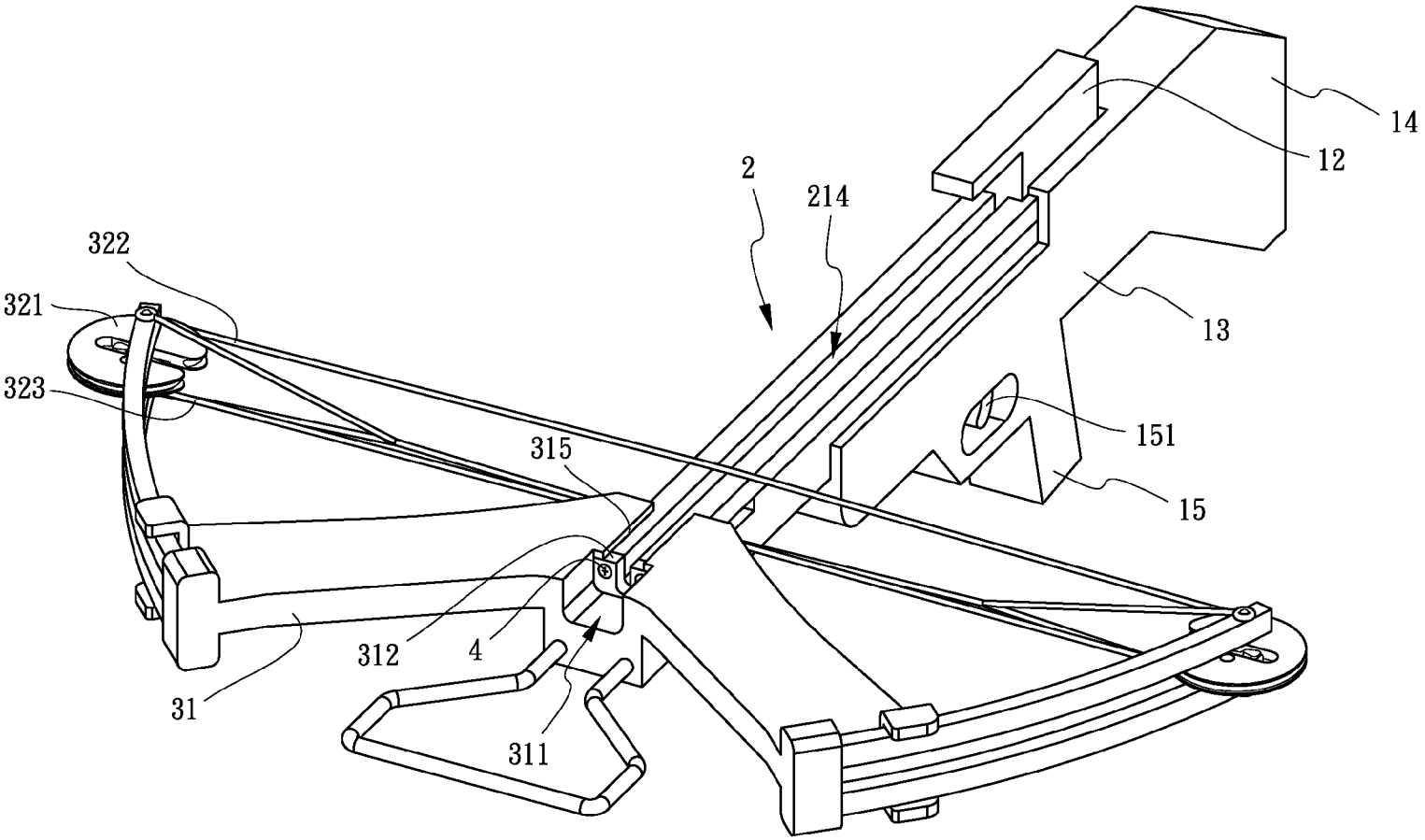
FIG. 4 shows a perspective view to show another embodiment of the crossbow assembly of the present invention.
Figure 5:
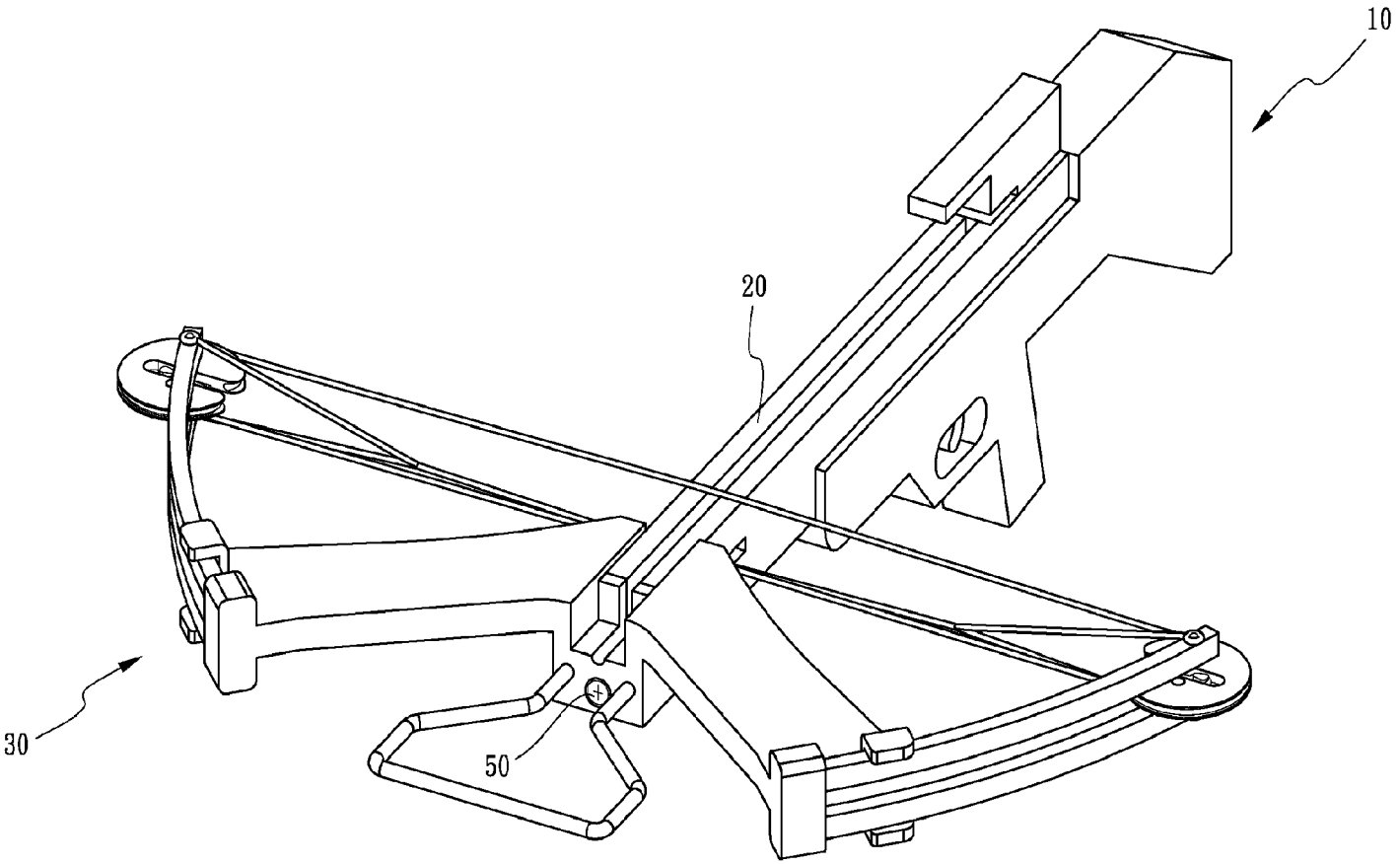
FIG.5 (Prior art)
FIG. 5 shows a perspective view of a conventional crossbow assembly.
Figure 6:
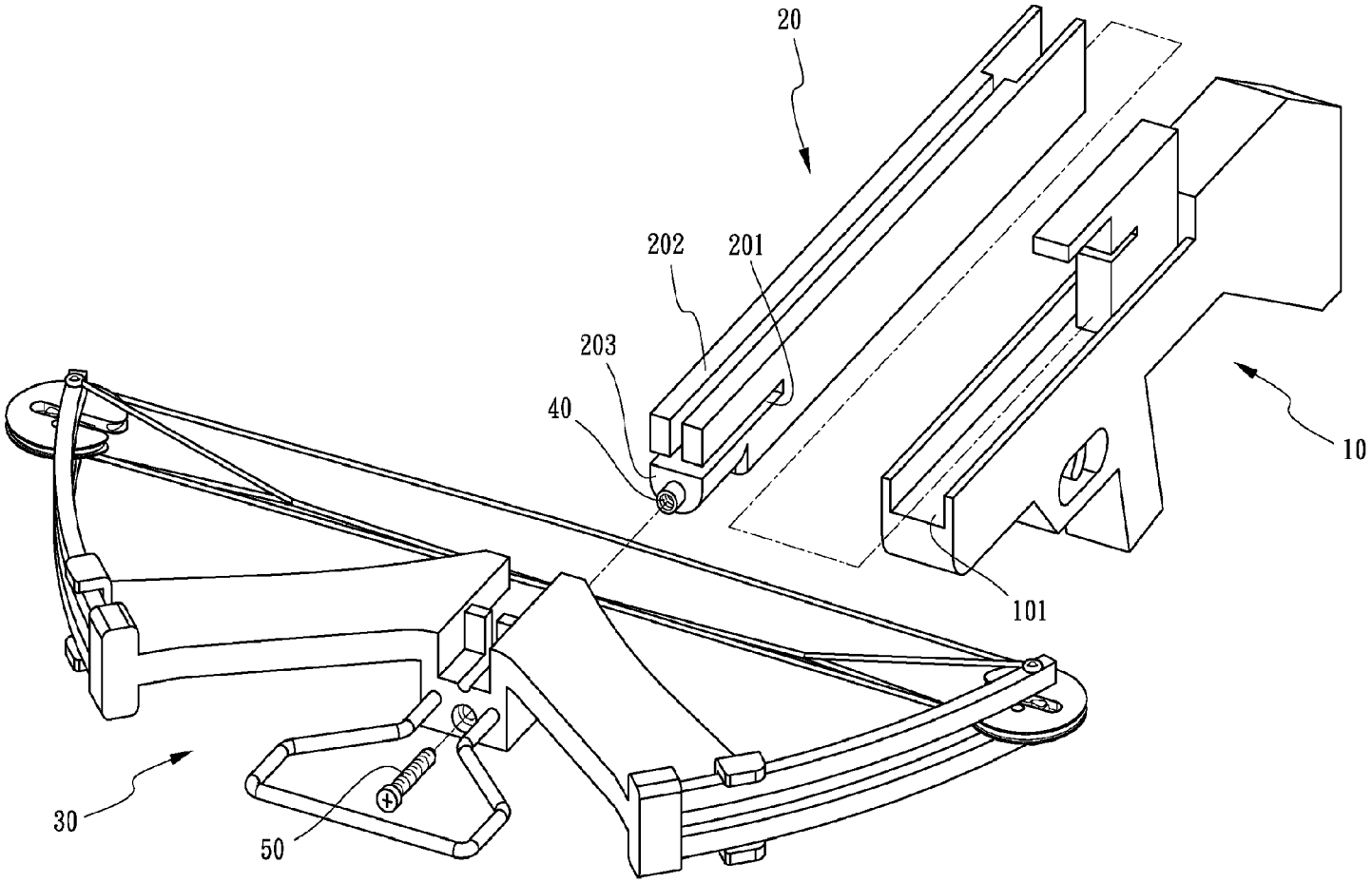
FIG.6 (Prior art)
FIG. 6 is an exploded view of the conventional crossbow assembly.

FIG. 4 shows the second embodiment of the present invention wherein there are two flanges 315 respectively extending from two sides of the slot 311 of the riser 31 and the two flanges 315 extend toward each other and contact the top of the upper portion 211. The upper portion 211 is further pressed and positioned by the two flanges 315 to prevent vibration or shaking between the upper portion 211 and the barrel 2. The flanges 315 can be formed as a large one-piece flange.

The user holds the grip 15 and contacts the stock 14 at the front side of the user's shoulder. The other hand holds/supports the lower portion of the main part 13. By pulling the trigger 151, the string 322 is disengaged from the retention member 12 and shoots the arrow out.

There are only few parts needed to assemble the crossbow assembly of the present invention, and the bow unit 3 can be separated from the barrel 2 by removing the two bolts 4. The assembling and dis-assembling are easy and convenient. The present invention makes storage and transportation more efficient.

While we have shown and described the embodiment in accordance with the present invention, it should be clear to those skilled in the art that further embodiments may be made without departing from the scope of the present invention.

What is claimed is:

1. A crossbow assembly comprising:

a body having an insertion hole defined therein and a retention member protruding from the insertion hole;

a barrel having a first end inserted into the insertion hole and connected with the retention member, a second end of the barrel extending beyond the insertion hole, a recess defined in a top of the second end of the barrel, an upper portion connected to a top of the barrel, a first end of the upper portion inserted into the insertion hole, a lower portion being formed at an underside of the barrel, the recess located between the upper portion and the lower portion, a thickness of the upper portion being smaller than or equal to a half of that of the lower portion, two threaded holes defined axially in an end face of a second end of the upper portion;

a bow unit connected to the second end of the upper portion and having a riser, two limbs connected to two ends of the riser and two cam units respectively connected to the two limbs, a slot defined in the riser and two plates extending from an inside of the slot, the two plates located at a distance from each other, each plate has a hole, and two bolts extending through the two holes of the two plates and being threadedly connected to the two threaded holes of the upper portion.

2. The crossbow assembly as claimed in claim 1, wherein the upper portion has a flight groove defined centrally in a top thereof, the flight groove communicates with the recess.

3. The crossbow assembly as claimed in claim 1, wherein the cam units each have a cam connected to the limb corresponding thereto, a string is wrapped between the two cams on the two limbs, a buss cable is connected between the two cams, the buss cable passes through the recess and is located between the upper portion and the lower portion, the string extends above the upper portion.

4. The crossbow assembly as claimed in claim 2, wherein the cam units each have a cam connected to the limb corresponding thereto, a string is wrapped between the two cams on the two limbs, a buss cable is connected between the two cams, the buss cable passes through the recess and is located between the upper portion and the lower portion, the string extends above the upper portion.

5. The crossbow assembly as claimed in claim 1, wherein two flanges respectively extend from two sides of the slot of the riser and toward each other so as to contact a top of the upper portion.

6. The crossbow assembly as claimed in claim 1, wherein the body has a main part, a stock and a grip, the insertion hole is defined in a top of the main part, the stock is located at a first end of the main part, the grip extends from an underside of the main part and a trigger is pivotably connected to the grip so as to activate the retention member.

7. A crossbow assembly comprising:

a body having an insertion hole defined therein and a retention member protruding from the insertion hole;

a barrel having a first end inserted into the insertion hole and connected with the retention member, a second end of the barrel extending beyond the insertion hole, a recess defined in a top of the second end of the barrel, an upper portion connected to a top of the barrel, a first end of the upper portion inserted into the insertion hole, a lower portion being formed at an underside of the barrel, the recess located between the upper portion and the lower portion, a thickness of the upper portion being smaller than or equal to a half of that of the lower portion, two threaded holes defined axially in an end face of a second end of the upper portion;

a bow unit connected to the second end of the upper portion and having a riser, two limbs connected to two ends of the riser and two cam units respectively connected to the two limbs, a slot defined in the riser and two plates extending from an inside of the slot, the two plates located at a distance from each other, each plate has a hole, two flanges respectively extending from two sides of the slot of the riser and toward each other so as to contact a top of the upper portion, and two bolts extending through the two holes of the two plates and being threadedly connected to the two threaded holes of the upper portion.

* * * * *